US008307608B2

(12) United States Patent
Harig et al.

(10) Patent No.: US 8,307,608 B2
(45) Date of Patent: Nov. 13, 2012

(54) MODULAR PANEL WALL ASSEMBLIES

(76) Inventors: Christopher W. Harig, Ashland, PA (US); Walter B. Bradley, Schuylkill Haven, PA (US)

( * ) Notice: Subject to any disclaimer, the term of this patent is extended or adjusted under 35 U.S.C. 154(b) by 672 days.

(21) Appl. No.: 12/422,680

(22) Filed: Apr. 13, 2009

(65) Prior Publication Data

US 2009/0193734 A1 Aug. 6, 2009
US 2012/0240499 A9 Sep. 27, 2012

Related U.S. Application Data

(63) Continuation-in-part of application No. 11/804,621, filed on May 18, 2007, now Pat. No. 8,186,115.

(60) Provisional application No. 60/801,568, filed on May 18, 2006, provisional application No. 60/904,012, filed on Feb. 28, 2007.

(51) Int. Cl.
*E04C 2/34* (2006.01)

(52) U.S. Cl. ..... 52/792.1; 52/481.1; 52/782.1

(58) Field of Classification Search ..... 52/144, 52/145, 792.1, 792.11, 784.12, 784.13
See application file for complete search history.

(56) References Cited

U.S. PATENT DOCUMENTS 3,596,424 A * 8/1971 Ward ..... 52/330
3,611,653 A * 10/1971 Zinn ..... 52/241
4,041,667 A * 8/1977 Lindner et al. ..... 52/481.2
4,075,810 A 2/1978 Zakrzewski et al. ..... 52/585
4,235,054 A * 11/1980 Cable et al. ..... 52/210
4,706,422 A * 11/1987 Ashton ..... 52/145
5,479,749 A * 1/1996 Colasanto et al. ..... 52/236.9
5,564,235 A 10/1996 Butler ..... 52/126.6
5,588,271 A * 12/1996 Pitchford ..... 52/306
5,592,796 A * 1/1997 Landers ..... 52/241
5,787,651 A * 8/1998 Horn et al. ..... 52/144
5,830,378 A 11/1998 Butler ..... 249/18
6,076,320 A 6/2000 Butler ..... 52/294
6,120,723 A 9/2000 Butler ..... 264/333
6,125,608 A * 10/2000 Charlson ..... 52/847
6,148,583 A * 11/2000 Hardy ..... 52/693
6,199,336 B1 3/2001 Poliquin ..... 52/489
6,205,725 B1 3/2001 Butler ..... 52/292
6,263,636 B1 * 7/2001 Corston ..... 52/741.1
6,354,050 B1 * 3/2002 Pankoski ..... 52/293.3
6,367,764 B1 4/2002 Butler ..... 249/3
6,385,937 B1 * 5/2002 Alexandre ..... 52/653.1
6,389,778 B1 * 5/2002 Strange ..... 52/745.19
6,398,778 B1 * 6/2002 Gu et al. ..... 606/15
6,550,213 B1 4/2003 Butler ..... 52/741.15
7,596,923 B1 * 10/2009 Thomas et al. ..... 52/741.13
2001/0047637 A1 * 12/2001 Henderson et al. ..... 52/782.1
2004/0134162 A1 * 7/2004 Douglas ..... 52/741.1
2006/0179782 A1 * 8/2006 Cox ..... 52/653.1

* cited by examiner

*Primary Examiner* — Brian Glessner
*Assistant Examiner* — Adam Barlow
(74) *Attorney, Agent, or Firm* — Drinker Biddle & Reath LLP

(57) ABSTRACT

A modular wall panel have a wall face, a top cap, a bottom pan and two side framing studs at the perimeter sides extending vertically from the bottom pan to the top cap are all constructed integrally. The side framing studs also define a surface for at attaching finishing strips that extend from the base pan to the top cap. A foundation wall is constructed from a plurality of modular wall panels. The wall panels may also have interior vertical reinforcing studs with surfaces for attaching finishing strips at regular intervals. The panels may include a support column for a cross wall beam or for a support beam over a door frame opening. The panels may be used for upper floor exterior walls

18 Claims, 11 Drawing Sheets

MODULAR PANEL WALL ASSEMBLIES

RELATED APPLICATIONS

This application is a continuation-in-part of U.S. application Ser. No. 11/804,621 filed May 18, 2007, now U.S. Pat. No. 8,186,115 which claims the benefit of U.S. Provisional Application No. 60/807,568filed May 18, 2006, and U.S. Provisional Application No. 60/904,012 filed Feb. 28, 2007.

FIELD OF THE INVENTION

The invention relates generally to modular building construction, and more particularly to modular wall panels used in the construction of foundation walls and upper floor exterior walls.

BACKGROUND OF THE INVENTION

Building structures are often built upon perimeter wall foundations. Typical perimeter wall foundations have been formed from poured or modular concrete or built up by grouted blocks placed atop a concrete footing. The perimeter foundation walls, and any cross beams bridging across the walls, support the first floor and higher load bearing walls of the structure.

Structures such as manufactured and modular homes may be installed on interior piers as the primary foundation support rather than using the perimeter wall as the primary support. Even when using interior pier support, however, it often required by building code to provide some type of perimeter wall to reduce shear loads, seismic vibration effects and wind uplift, and to prevent flooding and pest invasion under the foundation. While a perimeter foundation in conjunction with these interior pier supports could be constructed as traditionally done with concrete or block before the building structure is lowered into position, the difficulties and expense of precise wall placement and leveling for this type of perimeter wall has led to the use of steel panels that can be hung from the perimeter floor boards of a manufactured or modular home, and then anchored at the bottom edge in a concrete-filled trench that serves as a footer for the foundation wall.

Panel assemblies for this type of steel panel perimeter foundation are known, such as the AnchorPanel® assemblies by Fast Track Foundation Systems. These are corrugated steel panels that can be cut to length and installed with lag screws hanging under the perimeter floor boards of a pier-supported structure. The corrugated shape provides stiffening against bending under vertical and side loads. The panels have the bottom 5 or 6 inches cut along the outfacing corrugation channel and bent inward at 90 degrees to form an anchorage flange that will be encapsulated in the concrete footer. While such steel panel foundations are easier to install than concrete or grouted block, the corrugated shape requires some external facing if it is to appear flat in areas exposed above ground or to be used to attach decorative surface finishing materials to make an attractive facade.

There is a need for more efficient and versatile wall panel assemblies for foundation walls, including panels with flat exterior wall surfaces, bottom anchorage for encapsulation in concrete slab floors, robust support for full foundation walls and cross wall beams, provisions for attached steel frame stairways, more variations of corners and curved panels, ease of thermal insulation, ease of drywall support, and reinforcing shear walls where much of the wall face is taken up by window and door cutouts.

Many of these objectives can be attained by using wall panel structures similar to those used in the construction of in-ground swimming pools, made from steel which can be galvanized or otherwise weather coated, with adaptations as necessary to serve as weight bearing foundation walls and shear walls for exposed foundations and upper floor exterior walls. The attainment of these and other objectives will become apparent in the description that follows.

SUMMARY OF THE INVENTION

According to one aspect of the invention, a perimeter foundation wall is constructed from modular wall panels with flat exterior wall surfaces. The panels are preferably made of steel. In one embodiment, the individual panels have a generally planar shape defining a wall face and a flange formed on each vertically extending side by bending the side edges of the panel at a right angle in the same direction. These side flanges have matching bolt holes to allow another panel to be joined to the panel on either side to form a section of vertical wall. The panels are also bent at the top and base into the same direction to the panel as the side flanges to form a top cap and base pan, as described more fully in the detailed description.

In an alternative embodiment, the individual panels have a generally planar shape defining a wall face, two vertical-side framing studs, a top cap and a bottom pan, that are all integrally constructed, preferably from a steel sheet. Each side framing stud of the panel extends at a right angle away from the wall face to a side depth distance to form a panel side wall. The side walls have matching bolt holes to allow similar panels to be joined to the panel on either side, as in the previous embodiment. Different from the previous embodiment, however, each side-framing stud then is bent and extends parallel to the wall face from the side depth distance toward the opposite side stud of the panel for a distance of about three quarter inch to two inches to form a surface for attaching a finishing strip. At the opposite end of the finishing strip surface the stud may be bent again to reflect back parallel to the panel side for a short distance toward the wall face.

In this embodiment, the top cap again extends at a right angle from the wall face in the same direction as the side panels, but may now extend to a distance from the wall face that is longer than the side depth by substantially the depth of the finishing strip. The top cap is then bent downward to form a top flange that will lie over the finishing strips. Similarly, the base pan extends at a right angle from the wall face in the same direction as the side panels to a distance from the wall face that is longer than the side depth distance by substantially the depth of the finishing strip, and then is bent upward to form a bottom flange to overlie the finishing strips As small variations on the above embodiment, the top cap may only extend to the side depth before bending downward to form a flange over the side studs, so that the finishing strips provide a thermal barrier between the metal panel and any drywall or other wall covering. The bottom flange may also be longer than the top flange to provide a screed support for leveling a poured concrete floor pad.

The finishing strips are made from non-metallic material having good insulating properties to form a thermal barrier between the wall panel and any interior wall surface such as drywall or paneling. The strips also have sufficient strength to hold staples, screws, drywall nails or similar fasteners used to support interior wall surface materials or wall hangings on hangers passing through the drywall. While natural wood could be used, engineered wood or plastic composite provides sufficient strength and thermal barrier in narrow strips and are preferred for that reason. The finishing strips are attached to each side wall framing support and extend from the bottom pan to the top cap In the first embodiment where the side walls are just flat side flanges extending from the wall face, the panel side walls may be reinforced as needed by vertical "C"-shaped support brackets bolted to one or both panel side walls along the seams where adjacent panels are bolted together. In the embodiment where the side walls are also integral framing supports with a finishing strip surface, no additional vertical support bracket is needed at the side wall seams. In both embodiments, the side walls and the vertical framing studs have aligned cutout chase-ways to accommodate the passage of electrical conduit and/or fluid piping along the wall.

The wall panels may also be reinforced by vertical reinforcement studs as interior framing studs spaced at regular intervals (e.g. at 16 inch centers on a 48 inch wide panel). The interior studs are generally "Z-shaped. In a preferred embodiment, the vertical reinforcement studs have a top and bottom plate for contact against the top cap and bottom pan of the panel and, similar to the side framing studs, extend parallel to the wall face for a distance of about three quarter inch to two inches to form a surface for attaching a finishing strip, and at the opposite end of the finishing strip surface reflect back a short distance toward the wall panel's face. In this embodiment a finishing strip is attached to each vertical framing stud and extends from the bottom pan to the top cap.

The top caps of the panels, supported by the framing studs, provide a base for a sill plate. The base pans of the panels provide an anchor that can be fastened to a concrete footer or be encapsulated in a concrete slab floor. The corners of the foundation wall may be formed by corner panels. The corner panels can form a right angle corner, or be curved corners of various radii. The right angle corners can be either inside corners (90 degree) or outside corners (270 degree). The corner panels have side walls that match with the flat wall panels, and bolt holes and conduit cutouts aligned with those in the wall panels. The corner pieces also have a top cap and base pan like the wall panels, and may have surfaces for attaching finishing strips.

A beam support post may be installed between adjacent wall panels to form a beam pocket in which to seat a beam extending across the foundation to a similar beam pocket located on an opposite side of the perimeter wall. Alternatively, a beam support post may be installed within a wall panel, with the panel's top cap having a gap to accommodate the beam.

A modular stair well may be placed between adjacent wall panels to form a basement walkout or egress. Windows, doors and egress windows may be formed in above grade sections of the wall. Where the windows or doors are in a shear wall, beam pockets may support a hollow beam over door or window openings for greater shear resistance.

The panels may have insulation material sprayed onto the inside of wall face. The panels may also be coated with a decorative protective finish, such as Rhino Lining™ finish.

Wall panels of the embodiment having two vertical-side framing supports and finishing strips are preferred when constructing the foundation walls of a full height basement. According to one exemplary method of using the panels to construct the foundation walls for a full height basement, a foundation outline box is laid out and the basement pit is excavated to below the frost line with an over-dig of at least about two feet wider than the outline box. A layer of crushed stone may be needed depending upon soil condition. Drainage piping and other filter or vapor membranes may be used under the area where the concrete slap floor will be poured. A perimeter footer wider than the width of the wall panels is poured and leveled in the outline of the foundation.

Wall panels pre-manufactured to the particular foundation wall specifications are then assembled together with bolts at the side wall seams. The assembly preferably starts at a corner section and works both directions from the corner. The corner panel is set in place and aligned on the footer. There are pre-punched anchor holes in the base pan of the corner panel through which anchor holes can be drilled into the footer. Concrete anchor screws (e.g. TAPCON™ screws) and washers are used to immobilize the panel on the footer as the other panels are assembled to it. At each side seam, a bead of urethane sealant is drawn about one quarter inch thick running along the top cap then down to the bottom pan in the surface between the wall face and the bolt holes. After checking alignment and level, more concrete anchor screws can be used to immobilize the wall section as the next adjacent panels are bolted on.

When all of the wall panels are joined and leveled, a continuous bead of urethane sealant is also placed at the seam between the concrete footer and the base pan at both the interior and exterior sides of the wall area. A concrete slap floor may be poured in the interior basement space between the walls. If the wall panels are intended to be encapsulates in the slab, the panels are made with a short flange on the bottom pan such that the poured concrete flows into the entire base pan. Alternatively, if the intention is to contain the slab along the inside perimeter formed by the base pan, the flange of the base pan is increased in height and serves as a screed support for leveling the poured concrete. Any cross beams or other support beams are placed into the beam pockets. A sill plate is then installed over the top cap to fix the top alignment of the panels and ready the foundation for support of upper levels.

Upper levels of the building structure may also use the wall panels of the present invention, particularly where the exterior walls may be subject to high shear forces or need increased weight bearing capacity.

DESCRIPTION OF THE INVENTION THROUGH EMBODIMENTS

Figure 1:
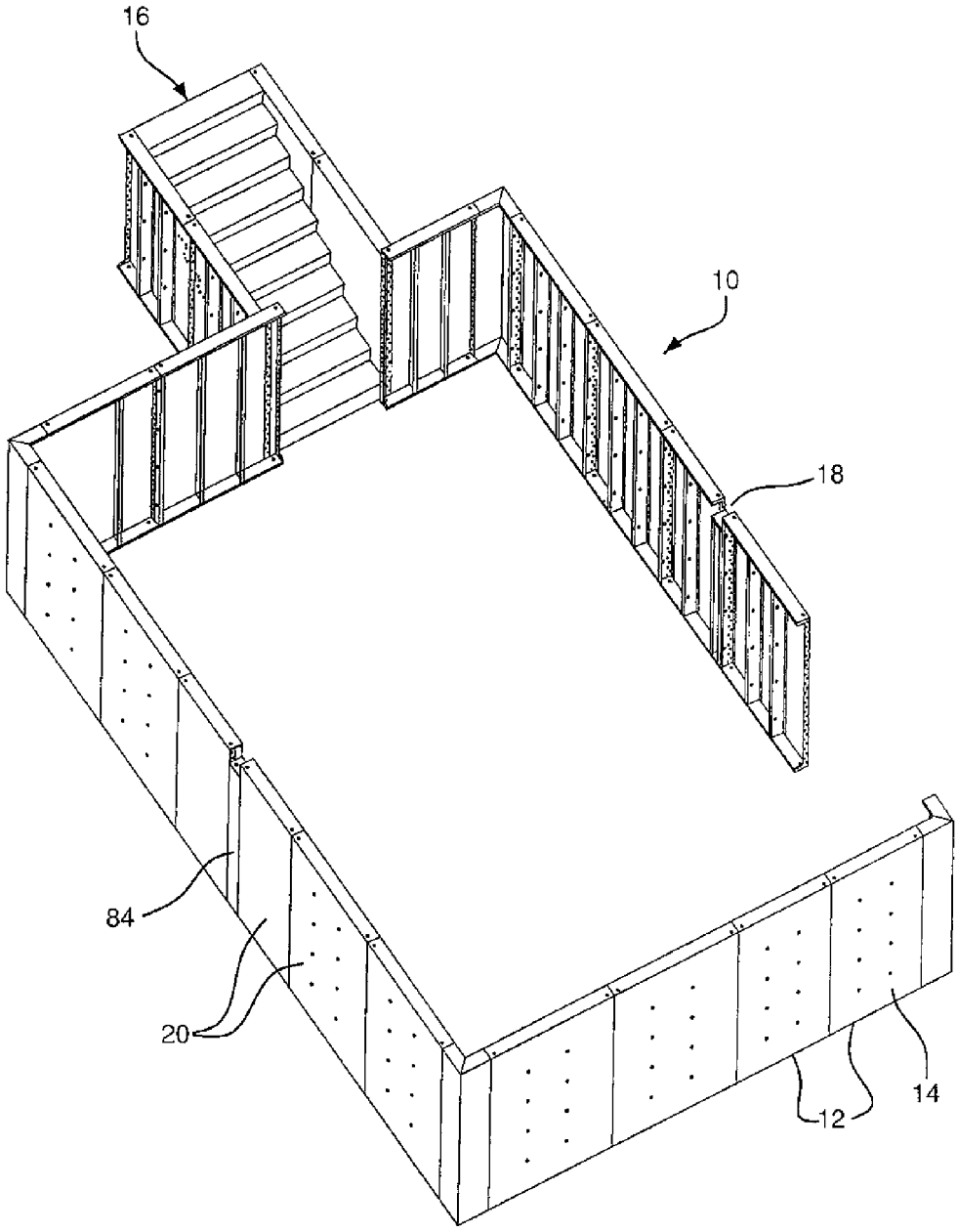
FIG. 1 is a top front perspective view of a basement wall constructed from wall panels having a generally fiat exterior face in which the basement perimeter wall provides the main support for the building foundation, coupled with a cross beam pocket.
Figure 2:
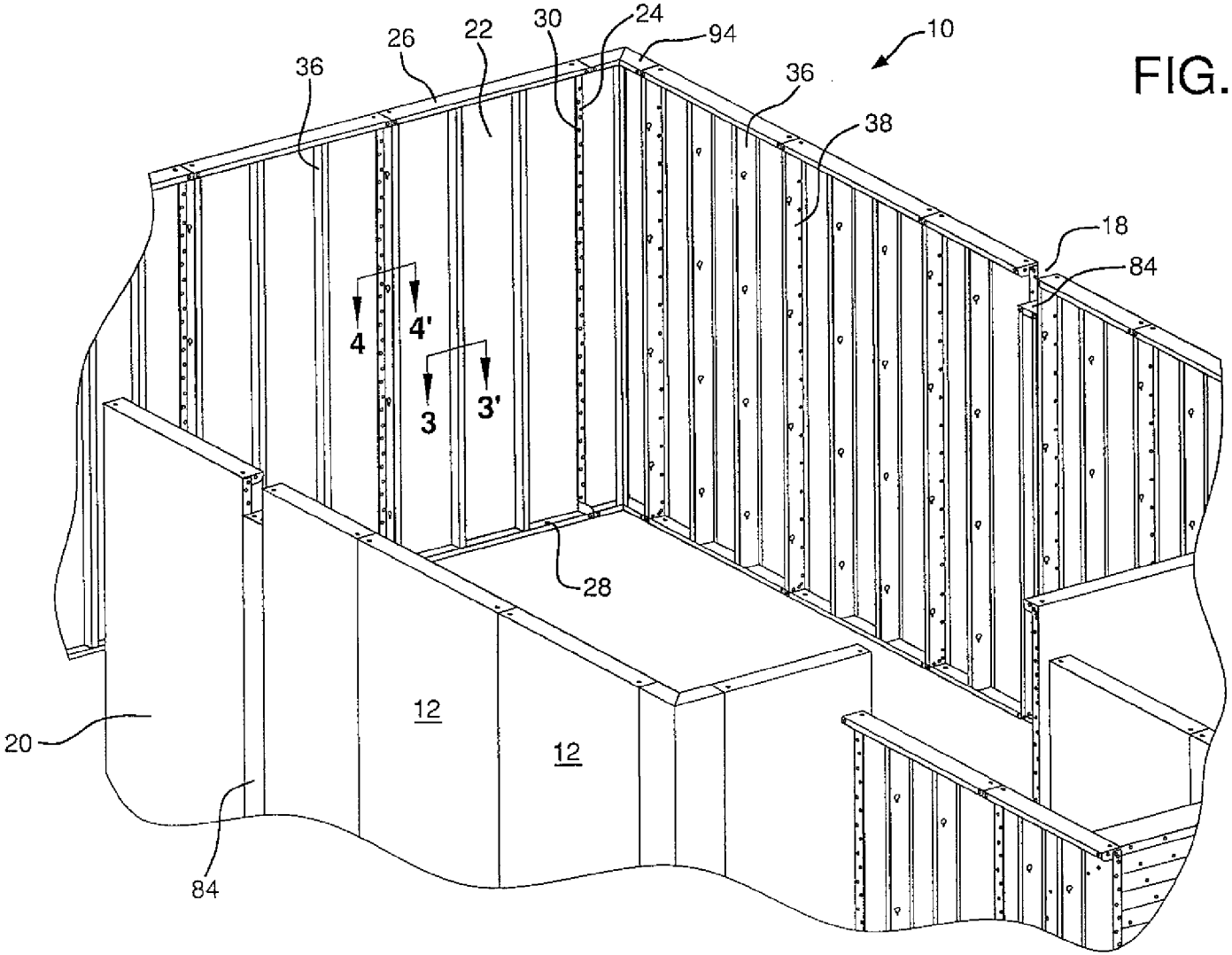
FIG. 2 is a top rear prospective view of the basement wall of FIG. 1.

Referring to the drawings, where like numerals identify like elements, FIGS. 1 and 2 illustrate an in-ground basement foundation where the basement perimeter wall is the primary foundation for a building. A foundation of this type may include one or more cross beams supported in two opposite beam pockets of the wall. Attached to the wall is a steel staircase forming a basement walkout. This figure will be used to identify elements of a foundation constructed from modular wail panels having a generally flat exterior face.

As shown in FIGS. 1 and 2, the foundation wall 10 is formed from preformed structural wall panels 12. A preferred panel is made from a steel sheet, for example a 14-gauge galvanized G-235 steel sheet that is stamped and bent into the desired shape and then weather coated with a spray-on polyurea or similar protective coating. Each of the panels 12 includes an upstanding wall portion 14 that is substantially smooth on its outside surface (the outside surface may have minor irregularities such as the stubs of mechanical fasteners such as toggle locks or rivets used to attach vertical reinforcing studs and beam supports on the interior side, as described below).

Attached to the wall 10 is a steel stair well 16 with steps to provide a walkout exit. The wall 10 also includes two opposite beam pockets 18 to accommodate a cross wall support beam. A longer wall could have more than one cross beam. Cross beams can also be used with walls of different shapes and dimensions. The structural wall panels 12 have a generally flat or planner outside surface 20, although the panels can be curved for customized buildings where the foundation is not rectangular and yet retain a smooth outside surface. Standard panels are 4-foot wide and up to 10 foot in height, but custom panels can be made in various dimensions.

The panel can be constructed from a steel sheet by cutting or punching the dimensions and bolt holes and keyways, and then bending the edges to form the panel. As shown in FIG. 2, the inside surface of a panel may have a generally flat portion 22 in its interior, but it is bent at the edges. In one embodiment of the panels, the individual panel 12 has a side flange 24 formed on each vertically extending side by bending the two side edges of the panel at a right angle in the same direction. The wall panel 12 also is bent at its top edge to from a top cap 26, and at its bottom edge to form a base pan 28, extending in the same direction as the side flanges 24. The side flanges have bolt holes 30 at set intervals to allow two panels to be joined together by bolts and nuts.

Figure 3:
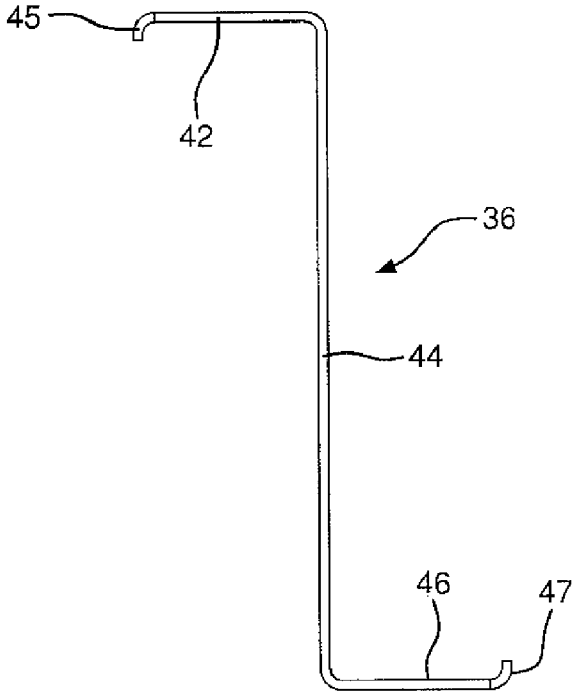
FIG. 3 is a section view of a vertical reinforcing stud taken along the line 3-3' in FIG. 2.

Depending upon how much load the perimeter wall be subjected to, the wall panels may require additional structure to resist bending. When the perimeter wall 10 is the main support structure of the foundation, as in the basement wall embodiment of FIGS. 1 and 2, the wall panels may require additional structure to resist bending under the vertical and side loads. In this embodiment of wall panel, vertical reinforcement members or framing studs 36 are spaced at regular intervals (i.e., at 16 inch centers on a 48 inch wide panel) and vertical support brackets 38 are placed along the seams where adjacent panels are bolted together provide such resistance. The vertical reinforcement members (or framing studs) 36 are preferably 14 gauge coated steel channels having a roughly Z-shaped cross section as shown in FIG. 3. One flange 42 is fastened against the flat surface 22 on the inside of the wall panel. The web 44 of the stud 36 extends inwardly perpendicular to the plane of the wall then is bent at a right angle to form a second flange 46 in the direction opposite the first flange 42. One or both flanges may terminate with a short reflected edge 45, 47 that extends parallel to the web 44. The spacing of the vertical reinforcement studs can be matched to the expected load. For example, in the basement wall shown in shown in FIGS. 1 and 2, the studs can be placed at 8 inch, 12 inch or 16 inch centers depending upon the expected vertical and side loading. The studs 36 may have cutouts to allow passage of electrical conduit or plumbing.

Figure 4:
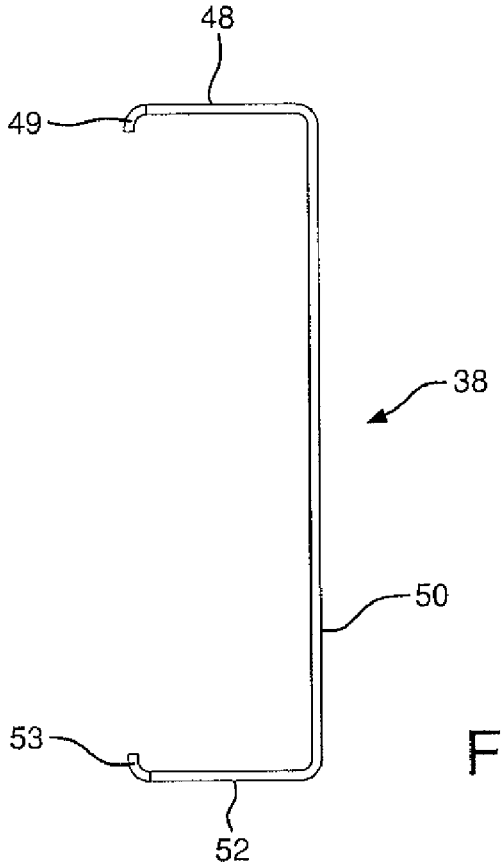
FIG. 4 is a section view of a vertical edge reinforcing bracket taken along the line 4-4' in FIG. 2

Vertical support brackets 38 are used to stiffen the wall panel connection between adjacent panels and to increase vertical support. A support bracket is preferably C-shaped in cross section as shown in FIG. 4. One flange 48 extends against the flat surface 22 on the inside of the wall panel. The web 50 of the bracket 36 extends inwardly perpendicular to the plane of the wall then is bent at a right angle to form a second flange 52 in the direction opposite the first flange 48. One or both flanges may terminate with a short reflected edge 49, 51 that extends parallel to the web 44. The web 50 has bolt holes arranged to align with the bolt holes in the side flanges of the wall panels. A bracket 38 can be attached to the wall flanges on one or both sides of a panel connection. The brackets 38 may have cutouts to allow passage of electrical conduit or plumbing.

Figure 5:
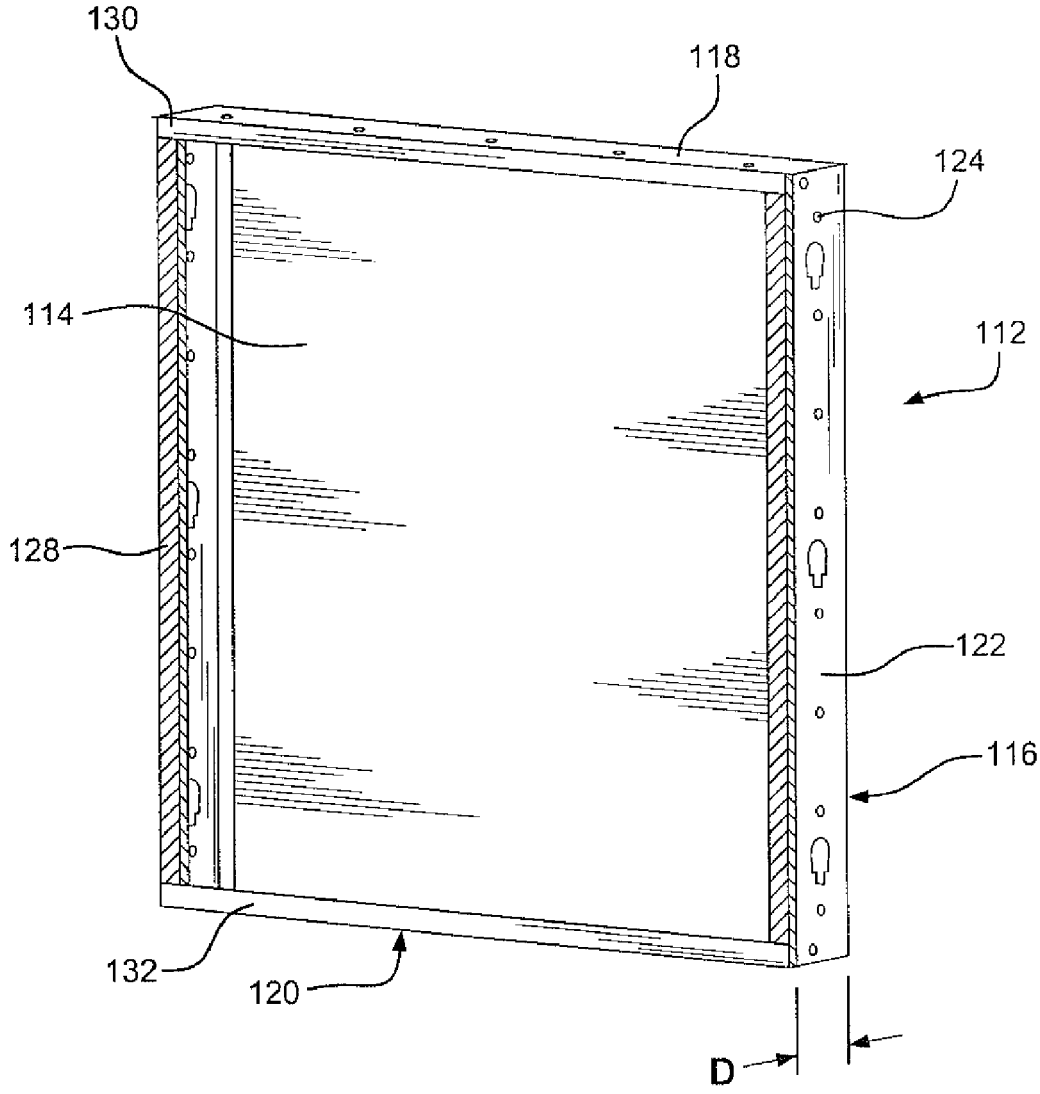
FIG. 5 is a perspective view of an alternative wall panel with integral side wall framing support.
Figure 6:
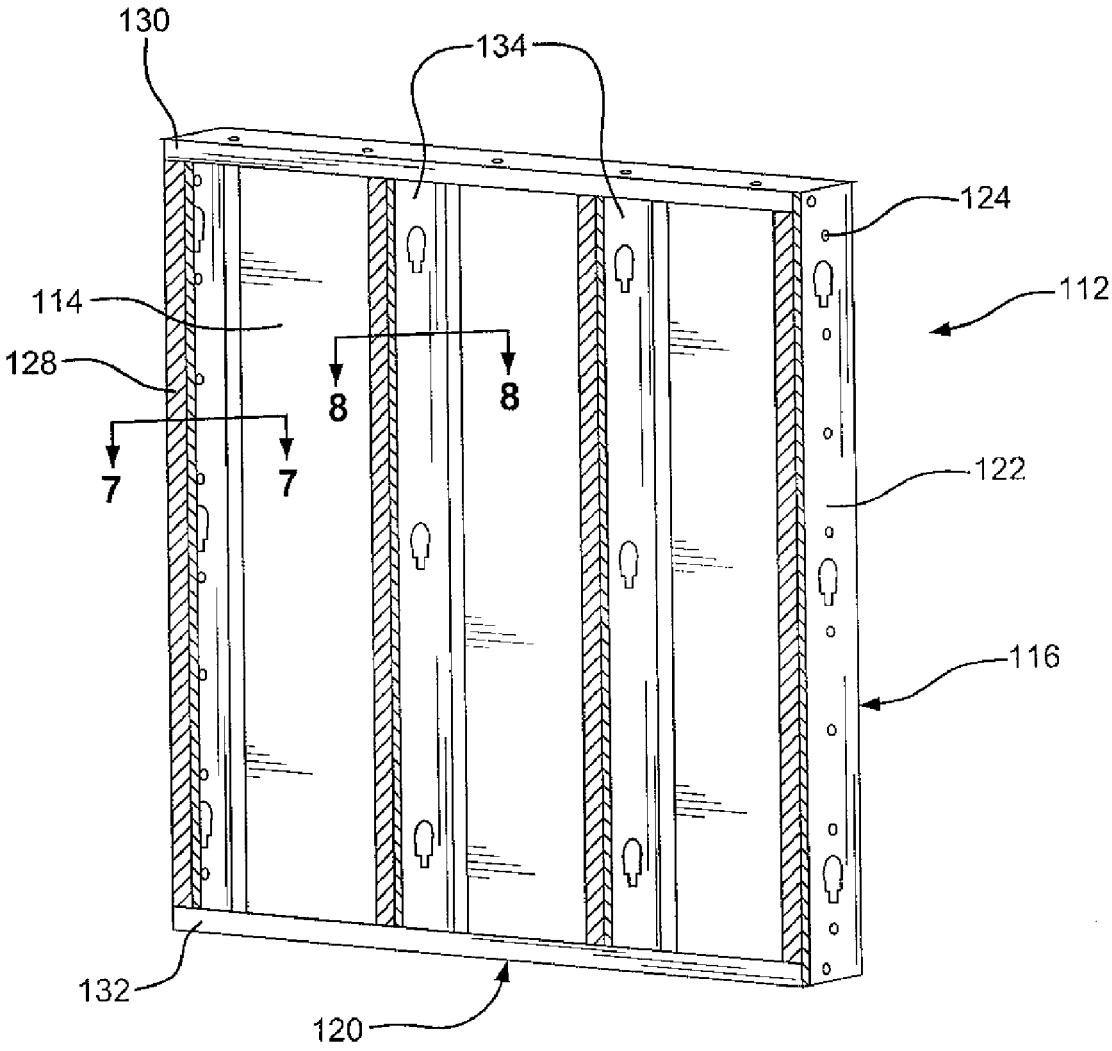
FIG. 6 is a perspective view of the wall panel of FIG. 5 with interior framing studs.
Figure 7:
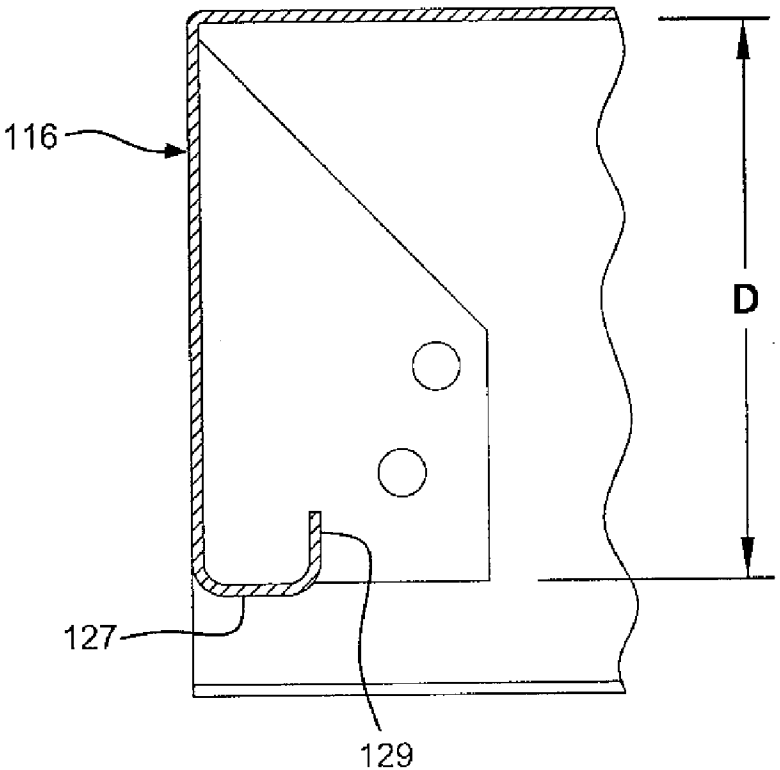
FIG. 7 is a section view of an interior reinforcing stud taken along the line 7-7' in FIG. 6.

In an alternative embodiment as shown in FIGS. 5 and 6, the panels have integral side framing studs. An individual panel 112 has a generally planar shape defining a wall face 114, two vertical-side framing studs 116, a top cap 118 and a bottom pan 120, all integrally constructed, preferably from a steel sheet. Each side framing stud 116 of the panel extends at a right angle away from the wall face 114 to a side depth distance D to form a panel side wall 122. The side walls have matching bolt holes 124 to allow similar panels to be joined to it on either side, as in the previous embodiment. As shown in FIG. 7, however, the side framing stud 116 then is bent and extends parallel to the wall face from the side depth toward the opposite side support of the panel for a distance of about three quarter inch to two inches to form a surface 127 for attaching a finishing strip 128. At the opposite end of the finishing strip surface 127 the stud is bent again to reflect back parallel to the panel side for a short distance toward the wall face as a support post 129. In this embodiment, the top cap 118 again extends at a right angle from the wall face in the same direction as the side panels, but here extends to a distance from the wall face that is longer than the side depth D by substantially the depth of the finishing strips. The top cap 118 is bent downward to form a top flange 130 over the finishing strips. Similarly, the base pan 120 extends at a right angle from the wall face in the same direction as the side panels to a distance from the wall face that is longer than the side depth distance by substantially the depth of the finishing strips, and then is bent upward to form a bottom flange 132 over the finishing strips.

In a variant of this embodiment, the top cap 118 extends only to the side depth D before being bent downward to form a top flange 130. In this variation, the finishing strips. Similarly, the base pan 120 extends at a right angle from the wall face in the same direction as the side panels to a distance from the wall face that is longer than the side depth distance by substantially the depth of the finishing strips, and then is bent upward to form a bottom flange 132 over the finishing strips. In this variation, the finishing strips overlie the top cap flange to provide a thermal barrier between the metal pane and the dry way or other wall covering.

In another variation, the bottom flange may be longer than the top flange, for example a 3-inch high bottom flange as opposed to a 1-inch top flange. The longer bottom flange may be used when the concrete basement floor is to be contained within the inside perimeter of the base pan. A shorter flange is used when the concrete is intended to flow over the flange and into the base pan.

Figure 8:
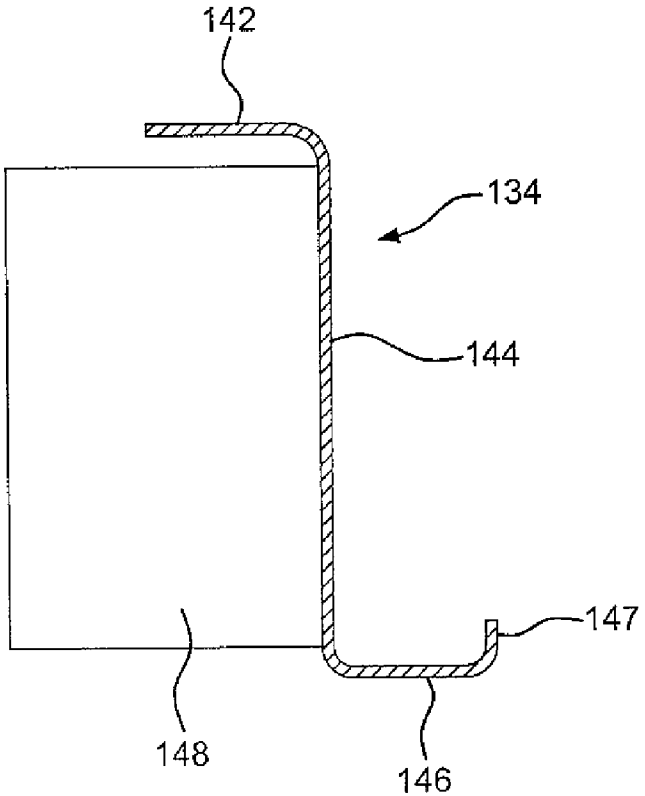
FIG. 8 is a section view of an integral sidewall reinforcing stud taken along the line 8-8' in FIG. 6.

In this embodiment of panel having integral side-framing studs, the interior framing studs 134, similar to the previously described side framing studs 116, are preferably 14 gauge coated steel channels having a roughly Z-shaped cross section, as shown in FIG. 8. One flange 142 is fastened against the flat surface of the inside of the wall panel. The web 144 of the stud extends inwardly perpendicular to the plane of the wall then is bent at a right angle in the direction opposite the first flange 142 and extends parallel to the wall face for a distance of about three quarter inch to two inches to form a surface 146 for attaching a finishing strip. One or both flanges may terminate with a short reflected edge 147 that extends parallel to the web 144. In addition, the top and bottom ends of the studs have an integral generally rectangular plate extending in opposite directions. The plate 148 in FIG. 8 is at the bottom end of the stud and extends to the left in the drawing. A similar plate (not shown) at the top of the stud extends to the right. Thus, the stud can be attached to the wall face by fasteners at the rear flange 142, to the base pan by fasteners into the bottom plate 148 and to the top cap by fasteners through the top plate. The spacing of the vertical reinforcement studs can be matched to the expected load, such as 12 inch or 16 inch centers, and cutouts matching those in the side framing to allow passage of electrical conduit or plumbing. A finishing strip 128 is attached the front flange surface 146 and extends from the bottom pan to the top cap.

The finishing strips 128 are made of non-metallic material having good insulating properties to form a thermal barrier between the wall panel and any interior wall surface such as dry wall or paneling. The strips also have sufficient strength to hold staples, screws, dry wall nails or similar fasteners used to support interior wall material or wall hangings. While natural wood could be used, engineered wood or plastic composite provides sufficient strength and thermal barrier in narrow strips and are preferred for that reason. The finishing strips 128 are attached to each side wall framing support and extend from the bottom pan to the top cap.

Figure 9:
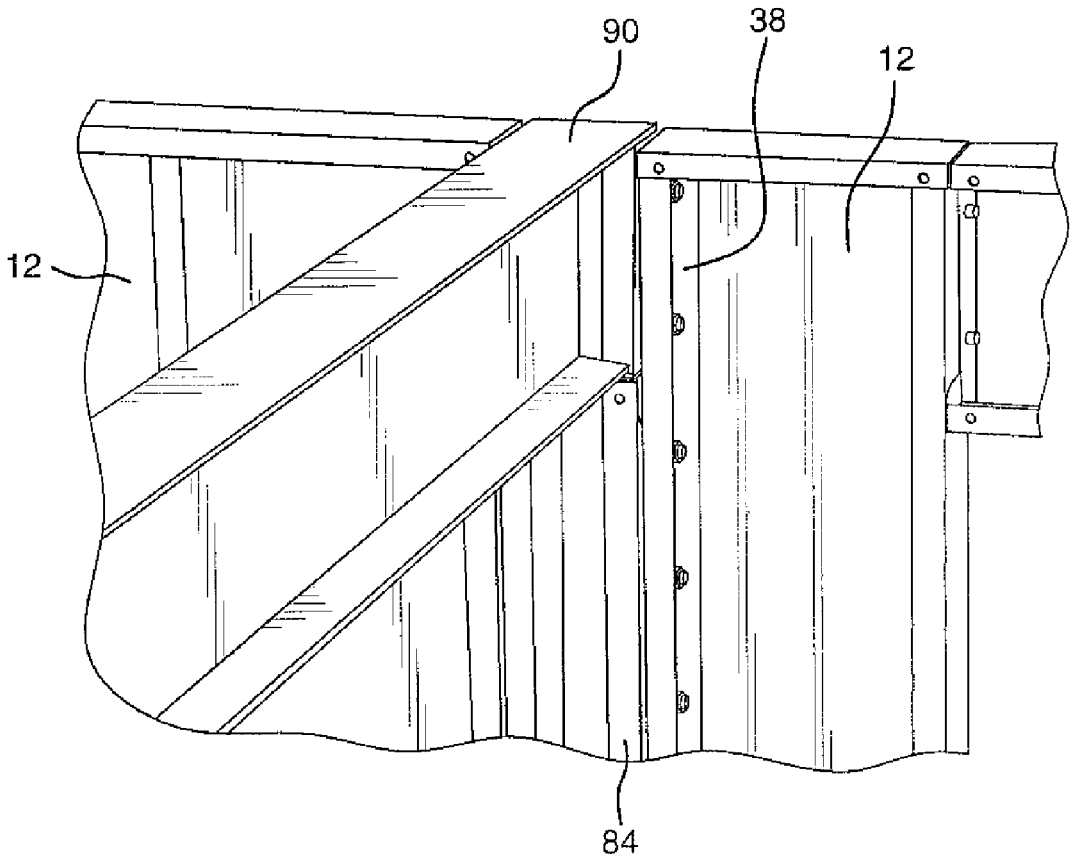
FIG. 9 is a view of a portion of a wail having a cross beam installed in a beam pocket between adjacent wall panels.

As shown in FIGS. 2 and 9, a beam pocket 18 may be formed in the perimeter wall by placing a beam post 84 between two wall panels 12. The beam post 84 is essentially the same configuration as a wall panel, except that it is shorter than the height of the wall panel by about the height of a standard steel I-beam 90, and is about the width of the beam's flanges, so that the I-beam sits conformingly in the beam pocket 18 formed between the two higher panels on each side. The sides of the beam post may be reinforced by bolting a "C" support bracket 38 (not shown, but essentially as in FIG. 4) 38 onto each side wall of the adjacent wall panels. The top of the beam post is covered by a plate and the beam may be fixed in the pocket by bolts extending through the plate and though holes drilled through base flange of the beam.

Figure 10:
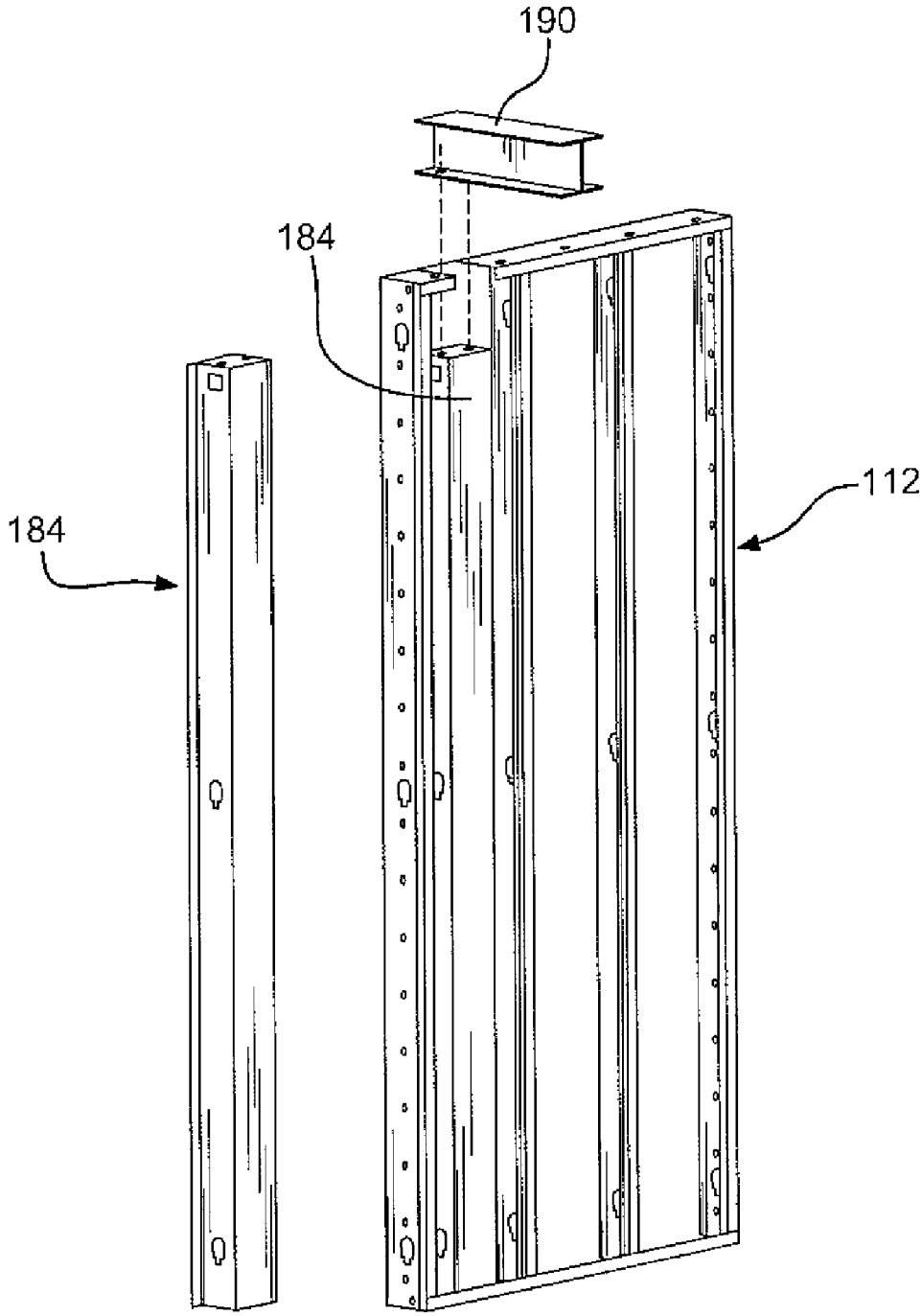
FIG. 10 is a view of a wall panel having an interior beam support within the panel.

Alternatively, as shown in FIG. 10, a beam support post 184 may be attached to the interior wall of a wall panel 112, instead of being located between adjacent panels. The beam support post 184 is preferably formed of 11 gauge steel. A pocket opening 188 in the top cap of the wall panel is stamped out of the sheet before it is bent to form the top cap. The beam post is shorter than the height of the wall panel by about the height of a standard steel I-beam, and is about the width of the beam's flanges, so that the I-beam 90 sits conformingly in the beam pocket. The top face of the support post has holes to accept fastening bolts though the bottom flange of a floor support cross beam. The column is attached to the wall panel by fasteners, such as Tog-L-Loc™ weldless fasteners.

Figure 11:
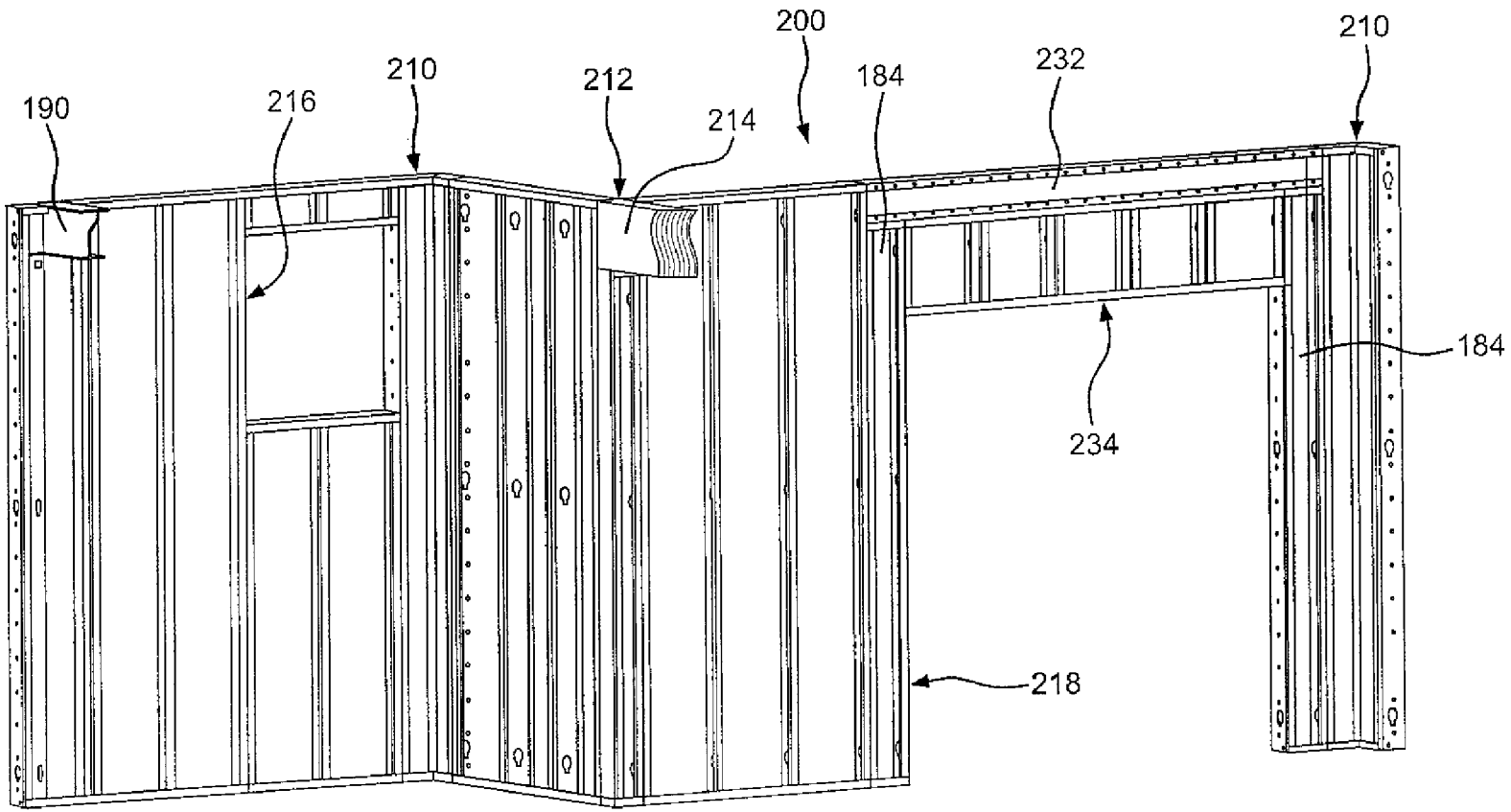
FIG. 11 is a view of a section of wall having inside and outside corners, cross beams, a window frame and a door frame.
Figure 12:
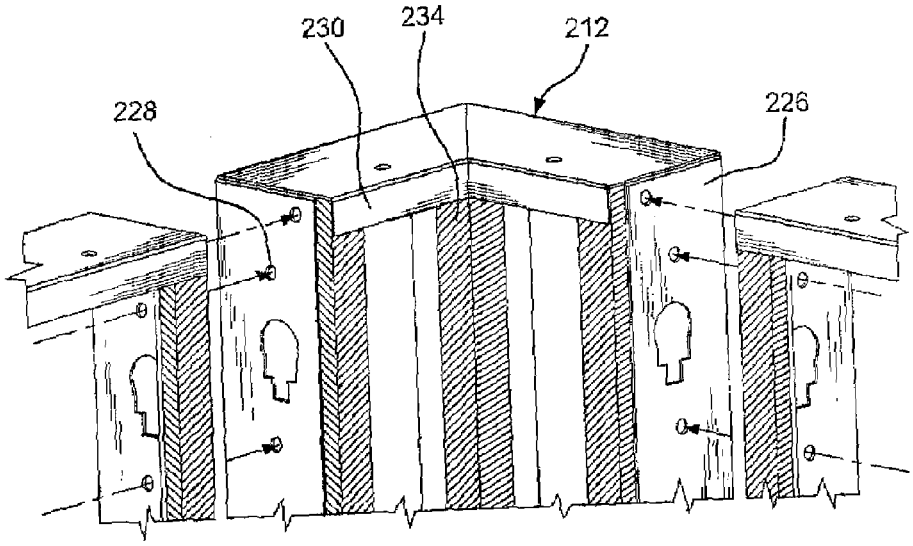
FIG. 12 is a view of an outside corner wall panel.
Figure 13:
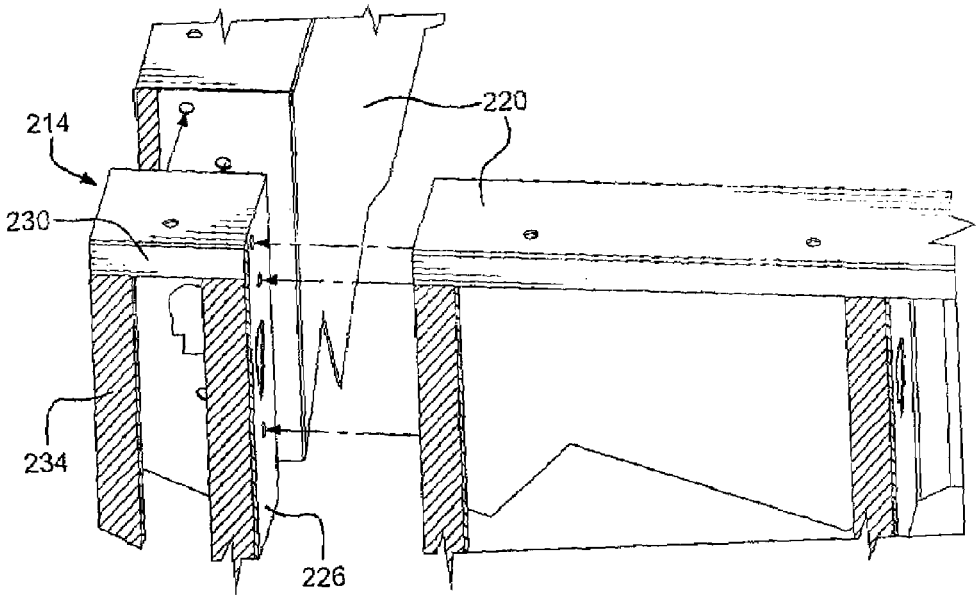
FIG. 13 is a view of an inside corner wall panel.

A section of wall 200 as shown in FIG. 11 has inside corners and outside corners, cross beams 190, 214, a window frame 216 and a door frame 218. The corners of the wall may be formed of corner panels 210 that form outside corners such as shown in FIG. 12, or panels 212 that form inside corners such as shown in FIG. 13. An inside corner panel 212 may be made shorter than the wall panels 220 on either side to form a beam pocket 222 for an interior cross beam 224. The outside corner panels 212 can form right angle corners, or be curved corners of various radii. The corner panels have side support studs 226 like the wall panels and have bolt holes 228 aligned with those in the wall panels. The corner panels also have a top cap 230 and base pan (not shown) extending over finishing strips 234 as with the wall panels.

Figure 14:
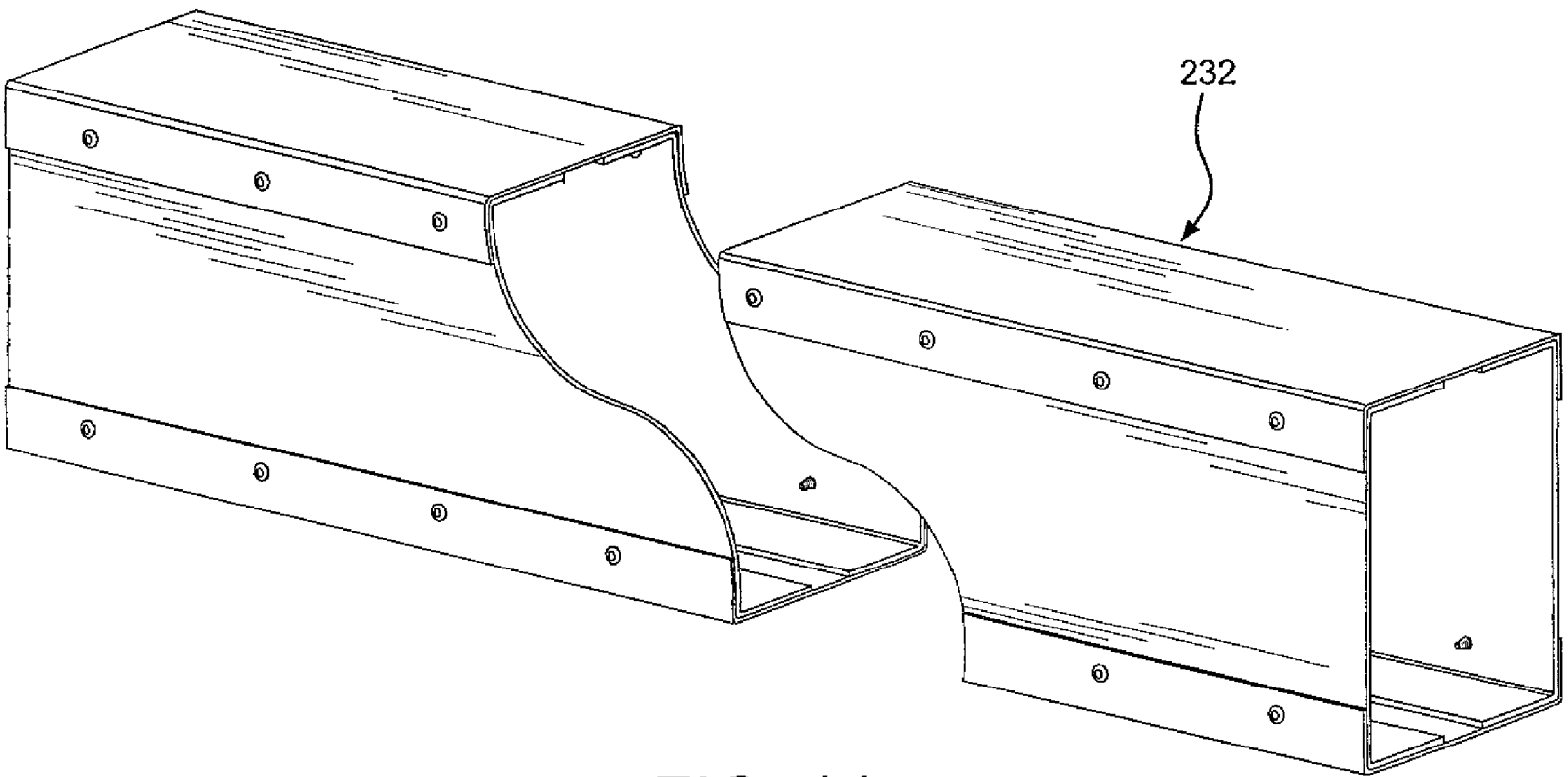
FIG. 14 is a hollow beam structure for support over lager window and door openings.

Windows and doors windows may be formed in above grade sections of the wall. Where large windows such as egress windows or doors form openings in a shear wall, a hollow support beam 230 (also shown in FIG. 14) may be used over the window or door 218 frames. The beam 232 is attached at each end over beam support posts 184 attached to the wall panels sides of the opening. A short wall panel skirt 234 may be attached to the bottom edge of the support beam.

A conventional sill plate (not shown) may be placed around the top caps of the wall panels and corner panels and over the cross beams. Floor joists are then placed across the walls transverse to the beam. To assist in locating and installing the floor joists, a joist anchor can be mounted on the sill plate. The joist anchor is an elongated 90 degree angle bracket formed from sheet steel of suitable thickness, such as 14 gauge. The sheet is cut to dimension and bent to a right angle at the bottom to form a short bottom flange having a width that is less than the width of the sill plate that will be laid on the foundation wall, and an upright flange having a height to make it approximately flush with the top of a floor joist placed in the anchor resting on the bottom flange. Holes may be drilled or stamped in the bottom flange to pass through anchor bolts extending from the foundation wall panels and cross beam though the sill plate. Holes may also be provided in the upright flange for screws attaching the end of the floor joist to the anchor, or the screws can self-drill these holes. Since the short bottom flange of the sill plate has a width that is less than the width of the sill plate, there is room behind the joist anchor to fit a trim board to cover the heads of the screws.

Although not shown in the drawings, insulation be sprayed or otherwise adhered to the inside surface of the wall panels and beam posts, preferably to an efficiency rating of R-14 or greater

EXAMPLE 1

BASEMENT FOUNDATION

According to one exemplary method of using the panels to construct the foundation walls for a full height basement, a foundation outline box is laid out and the basement pit is excavated to below the frost line with an over-dig of at least about two feet wider than the outline box. The pit is excavated to sufficient dimensions to accommodate the planned basement and allow working space around the exterior of the basement walls. A layer of crushed stone may be needed depending upon soil condition. Drainage piping and other filter or vapor membranes may be used under the area where the concrete slap floor will be poured. A concrete perimeter footer wider than the width of the wall panels is poured and leveled in the outline of the foundation, and includes the footer for a walkout stairwell if one will be installed. The footer should provide a smooth surface of about 8-12 inches (increased to three times the wall width under any cross beam posts) on which to erect and anchor the wall panels and stairwell.

If a steel stairwell is used, it is set in place and anchored first on the respective portion of the footer. If no stairwell is used, the assembly preferably starts at a corner section and works both directions from the corner. The wall panels made to the particular foundation wall specifications are then assembled together with bolts at the side wall seams. The vertical support studs preferably have been are fastened onto the wall panels at the proper spacing before the panels are connected together, the finishing strips have been installed on the side wall studs and vertical studs, and thermal insulation has been sprayed onto the inner wall surface prior to delivery of the wall panels to the site.

If starting a corner panel, it is set in place and aligned on the footer. There are pre-punched anchor holes in the base pan of the corner panel through which anchor holes can be drilled into the footer. Concrete anchor screws (e.g. TAPCON™ screws) and washers are used to immobilize the panel on the footer as the other panels are assembled to it. At each side seam, a bead of urethane sealant is drawn about one quarter inch thick running along the top cap then down to the bottom pan in the surface between the wall face and the bolt holes. After checking alignment and level, more concrete anchor screws can be used to immobilize the wall section as the next adjacent panels are bolted on. A wall panel having the beam post support column is used at the foundation location where a cross beam will span across opposite walls. Corner panels are used to make the inside and outside corners. Panels having window or door frames are placed in the intended locations. Preferably all of these pieces can be marked to indicate the order of installation and location prior to site delivery to reduce any likelihood of placing the wrong panel in a sequence.

When all of the wall panels are joined and leveled, a continuous bead of urethane sealant is also placed at the seam between the concrete footer and the base pan at both the interior and exterior sides of the wall area. A concrete slab floor may be poured in the interior basement space between the walls. In a preferred embodiment, the flange on the bottom pan is about three inches high and the depth of the slab is preferably poured up to the height of the flange, using the top of the flange as a screed support for leveling the concrete surface. Alternatively, the concrete could be allowed to flow into the base pan area and encapsulate the base of the panels. Any cross beams or other support beams are placed into the beam pockets. A sill plate is then installed over the top cap to fix the top alignment of the panels.

The outside surface of the wall structure may be sealed by caulking the seams and spraying a urethane sealing layer on the entire exterior wall before the pit is backfilled. The exterior surface may also be prepared for supporting a decorative facade. Support stakes may be attached to the wall to support a ledge or shelf mounted on the stakes at a height that will be below grade when the pit is back filled. The ledge can be used to support decorative facing, such as a brick stone facade. Other exterior surfaces visible above ground can be painted or covered with mesh and stucco or other decorative finish before or after backfilling the pit.

The wiring and any in-wall plumbing or conduit work can be installed through the keyway cutouts in the side walls and vertical supports. The dry wall or other surface cover can be hung on the finishing strips.

Although the use of the panels has been described above in relation to a foundation wall, it should be clear that the same panels could be used in upper floor exterior walls. The panels provide increased shear resistance and weight bearing capacity, and are easy to install by bolting side-by-side panels. The finishing strips provide ease of attachment for wallboard, and the keyways allow for wiring and other conduit. Thicker insulation may be required in upper floor wall panels. The outside surfaces of upper floor walls can be covered by siding or other facade material, or painted if an appearance other than the polyurethane coating is wanted.

We claim:

1. A modular wall panel comprising:

a wall face;

a top cap formed from a top edge of the wall face and bent to extend at a right angle from the wall face;

a bottom pan formed from a bottom edge of the wall face and bent to extend at a right angle in the same direction as the top cap from the wall face; and two side framing studs at the opposite sides of the wall face each formed from a side edge of the wall face and bent to extend at a right angle in the same direction as the top cap and the bottom pan from the wall face, the side framing studs extending vertically from the bottom pan to the top cap, each side framing stud at a right angle away from the wall face to a side depth distance to form a panel side wall having matching bolt holes to allow similar wall panels to be joined to the wall panel on either side, the side framing stud then being bent to extend parallel to the wall face from the side depth toward the opposite side wall of the panel to form a surface parallel to and oriented away from the wall face for attaching a finishing strip; and a non-metallic finishing strip attached to each side framing stud and extending from the bottom pan to the top cap;

wherein one of the top cap and the bottom pan extends at a right angle from the wall face in the same direction as the side framing studs to a distance from the wall face that is longer than the side depth distance by a length substantially the depth of the finishing strips, the one of the top cap and the bottom pan then extending parallel to the wall face to form a flange over the finishing strips.

2. A wall panel as in claim 1, wherein the other of the top cap and the bottom pan extends at a right angle from the wall face in the same direction as the side framing studs to a distance from the wall face that is longer than the side depth distance by a length substantially the depth of the finishing strips, the other of the top cap and the bottom pan then extending downward to form a flange over the finishing strips.

3. A wall panel as in claim 1, further comprising vertical reinforcing studs attached to an inner surface of the wall face at regular spacing between the side framing studs, and extending from the bottom pan to the top cap.

4. A wall panel as in claim 3, wherein the vertical reinforcing studs are roughly Z-shaped in cross section, having first flange that is fastened to an inner surface of the wall face, a web section that extends perpendicular to the plane of the wall face, and a second flange that is bent at a right angle in the direction opposite the first flange to form a surface parallel to and oriented away from the wall face for attaching a finishing strip; the wall panel further comprising:

a non-metallic finishing strip attached to each vertical reinforcing stud and extending from the bottom pan to the top cap.

5. A wall panel as in claim 4, wherein the finishing strip surfaces on the side framing studs and the vertical reinforcing studs extend for a distance of about three quarter inch to two inches and then reflect back toward the wall face.

6. A wall panel as in claim 1, further comprising vertical reinforcing studs attached to an inner surface of the wall face at regular spacing between the side studs, and extending from the bottom pan to the top cap, wherein the vertical framing studs are roughly Z-shaped in cross section, having first flange that is fastened to an inner surface of the wall face, a web section that extends perpendicular to the plane of the wall face, and a second flange that is bent at a right angle in the direction opposite the first flange to form a surface parallel to and oriented away from the wall face for attaching a finishing strip; the wall panel further comprising:

a non-metallic finishing strip attached to each vertical reinforcing stud and extending from the bottom pan to the top cap.

7. A wall panel as in claim 1 having a polyurea surface coating.

8. A wall panel as in claim 1 having thermal insulation disposed on the inside of the panel wall face.

9. A wall formed from a plurality of panels as in claim 1 that are bolted together.

10. A wall as in claim 9 having a corner panel that forms an outside corner in the wall.

11. A wall as in claim 9 having a corner panel that forms an inside corner in the wall.

12. A wall as in claim 9 having a door frame opening reinforced by a cross beam above the opening supported at both of its sides by a support beam in the wall panels adjacent the opening.

13. A wall as in claim 9, further comprising a cross beam support column located inside corresponding wall panels located opposite each other in the wall.

14. A wall as in claim 9, wherein the wall is anchored by a concrete slab floor poured inside of the wall.

15. A wall as in claim 9, wherein the concrete slab floor is poured to a depth greater than the height of the bottom flange such that concrete flows over the flange into and encapsulating the base pans Of the modular panels.

16. A wall panel as in claim 1, further comprising:

the top cap extending at a right angle from the wall face in the same direction as the side framing studs to a distance from the wall face that is longer than the side depth distance by a length substantially the depth of the finishing strips, the top cap then extending downward to form a top flange under the finishing strips.

17. A wall panel as in claim I, further comprising:

the bottom pan extending at a right angle from the wall face in the same direction as the side framing studs to a distance from the wall face that is longer than the side depth distance by a length substantially the depth of the finishing strips, the bottom pan cap then extending upward to form a bottom flange under the finishing strips.

18. A wall as in claim 9, wherein the wall is anchored to a concrete footer by anchor screws extending through the bottom pan and into the footer.

* * * * *